US008092321B2

(12) United States Patent
Chiang Huang

(10) Patent No.: US 8,092,321 B2
(45) Date of Patent: Jan. 10, 2012

(54) GOLF TEE WITH A CONNECTING WIRE AND MANUFACTURING METHOD THEREOF

(76) Inventor: Shu-Yuan Chiang Huang, Taoyuan (TW)

( * ) Notice: Subject to any disclaimer, the term of this patent is extended or adjusted under 35 U.S.C. 154(b) by 230 days.

(21) Appl. No.: 12/580,597

(22) Filed: Oct. 16, 2009

(65) Prior Publication Data

US 2011/0092316 A1 Apr. 21, 2011

(51) Int. Cl.
*A63B 57/00* (2006.01)

(52) U.S. Cl. ..... 473/393; 473/390

(58) Field of Classification Search ..... 473/387–403
See application file for complete search history.

(56) References Cited

U.S. PATENT DOCUMENTS 1,627,012 A * 5/1927 Copeland ..... 473/394
1,638,448 A * 8/1927 Manson ..... 473/394
1,655,751 A * 1/1928 Cody ..... 473/391
1,736,583 A * 11/1929 Deike ..... 473/396
2,159,893 A * 5/1939 Hansen ..... 473/393
2,668,710 A * 2/1954 Carlson ..... 473/393
4,114,878 A * 9/1978 Hammond ..... 473/394
4,336,940 A * 6/1982 Sprague ..... 473/393
5,221,090 A * 6/1993 Hong ..... 473/391
5,413,348 A * 5/1995 Basso ..... 473/393
2002/0123396 A1* 9/2002 Joo ..... 473/393

* cited by examiner

*Primary Examiner* — Steven Wong
(74) *Attorney, Agent, or Firm* — Kile Goekjian Reed & McManus PLLC

(57) ABSTRACT

A golf tee with a connecting wire includes a tee and a connecting wire. The tee has a nail rod and a ball holding portion connected with a top of the nail rod. The ball holding portion has a groove formed in a top thereof and a connecting slot formed in one side thereof. The connecting slot includes an opening portion, a passage portion and a fixing portion. One end of the connecting wire passes through the opening portion and the passage portion of the connecting slot into the fixing portion and forms a blocked portion which is located in the groove, so that the end of the connecting wire is connected with the tee. The present invention further provides a method of manufacturing a golf tee with a connecting wire. Accordingly, the connection and assembling between the connecting wire and the tee can be attained easily, firmly, and rapidly.

10 Claims, 11 Drawing Sheets

GOLF TEE WITH A CONNECTING WIRE AND MANUFACTURING METHOD THEREOF

BACKGROUND OF THE INVENTION

1. Field of the Invention

The present invention relates to a golf tee with a connecting wire and manufacturing method thereof, and more particularly to a golf tee with a connecting wire and manufacturing method wherein the golf tee has the connecting wire for avoiding loss of the tee.

2. Description of Related Art

With the improvement of people's living standard, people care more about their leisure lives and golf becomes more and more popular. In golf, for locating golf balls easily and elevating golf balls slightly above the ground prior to striking them initially, golf tees are disposed so that golf balls can be driven along desired paths for desired distance. Golf tees are driven into the turf via nail rods formed on lower portions of the golf tees and are used to support golf balls via ball holding portions formed on upper portions of the golf tees when the initial stroke is required to be a long one due to the length of a hole.

A conventional golf tee is generally connected with one end of a connecting wire of which the other end is connected with another golf tee. During application, both of the golf tees can be inserted into the ground together and pulled and limited by the connecting wire when golf balls are driven to bounce outwards, thereby avoiding that a single golf tee is struck and then be lost, ensuring that the golf tees can be reused, and saving the costs of purchasing replacing golf tees.

In conventional connection methods of a connecting wire and a golf tee, the golf tee must have a through-hole and one end of the connecting wire passes through the through-hole and then is tied to form a blocked portion with a large outer diameter, so that the end of the connecting wire is fixed in the golf tee. However, the operation is very difficult to extend the connecting wire through the through-hole, and thereby wasting time and energy, reducing the production efficiency, and increasing the costs.

Hence, the inventors of the present invention believe that the shortcomings described above are able to be improved and finally suggest the present invention which is of a reasonable design and is an effective improvement based on deep research and thought.

SUMMARY OF THE INVENTION

A major object of the present invention is to provide a golf tee with a connecting wire and manufacturing method thereof which can connect a connecting wire with a golf tee rapidly. The golf tee can be assembled easily and firmly and the manufacturing method can save time and energy, improve production efficiency and reduce costs.

To achieve the above-mentioned object, a method of manufacturing a golf tee with a connecting wire in accordance with the present invention is provided. The method includes the steps of: forming two tees of which ball holding portions each have a groove formed in a top thereof and a connecting slot formed in one side thereof, wherein the connecting slot includes an opening portion, a passage portion and a fixing portion which are disposed from top to bottom, the opening portion extends to the top of the ball holding portion, and a width of the passage portion is smaller than that of the opening portion; and pulling the connecting wire out, clamping the connecting wire via a fixture, cutting the connecting wire to a proper length and then fusing two ends of the connecting wire via heating so that the two ends of the connecting wire form blocked portions of which outer diameters are larger than an inner diameter of the fixing portions, and then inserting the two ends of the connecting wire into the connecting slots of the two tees through the opening portions from top to bottom via the fixture so that the two ends of the connecting wire pass through the passage portions of the connecting slots of the two tees into the fixing portions, the blocked portions are located in the grooves, and the two ends of the connecting wire are connected with and fixed in the two tees.

The present invention has the efficacy as follows: the ball holding portion of each tee associated with the present invention has the connecting slot and the connecting slot has the opening portion so that the top of the connecting slot is open to allow the connecting wire to be inserted into the fixing portion through the opening portion of the connecting slot, thereby achieving the connection between the connecting wire and the tee rapidly. The golf tee with a connecting wire of the present invention can be assembled easily and firmly, and the manufacturing method can save time and energy, improve production efficiency and reduce costs.

The connecting slot associated with the present invention has the passage portion which can elastically shrink by utilizing the elastic portion properly for preventing the connecting wire moving upwards along the connecting slot and avoiding the connecting wire escaping out of the connecting slot eventually.

The blocked portions (wire heads) formed on two ends of the connecting wire in accordance with the present invention can be automatically fusion-formed and the present invention can automatically clamps the connecting wire from top to bottom via a fixture, thereby improving production efficiency and reducing costs.

To further understand features and technical contents of the present invention, please refer to the following detailed description and drawings related the present invention. However, the drawings are only to be used as references and explanations, not to limit the present invention.

DETAILED DESCRIPTION OF THE PREFERRED EMBODIMENTS

Figure 2:
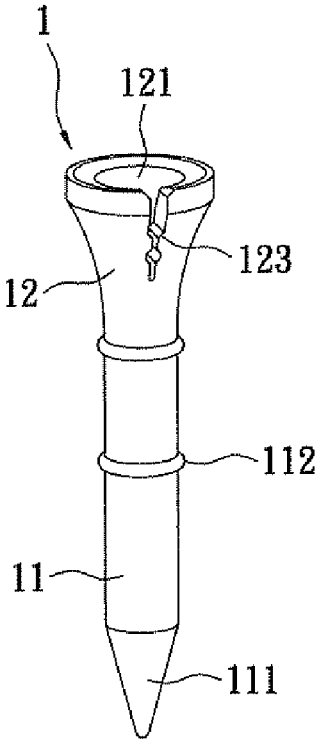
FIG. 2 is a perspective view of a second tee in accordance with the first embodiment of the present invention.
Figure 1:
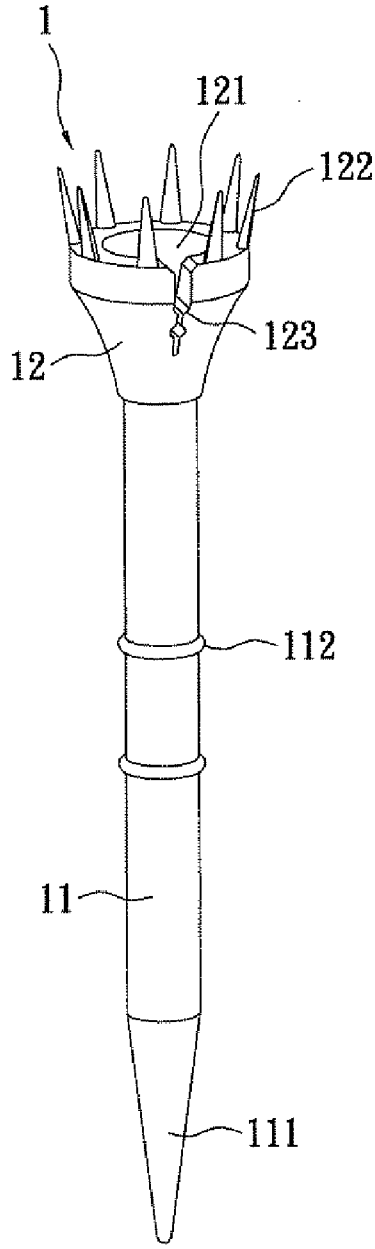
FIG. 1 is a perspective view of a first tee in accordance with a first embodiment of the present invention.
Figure 3:
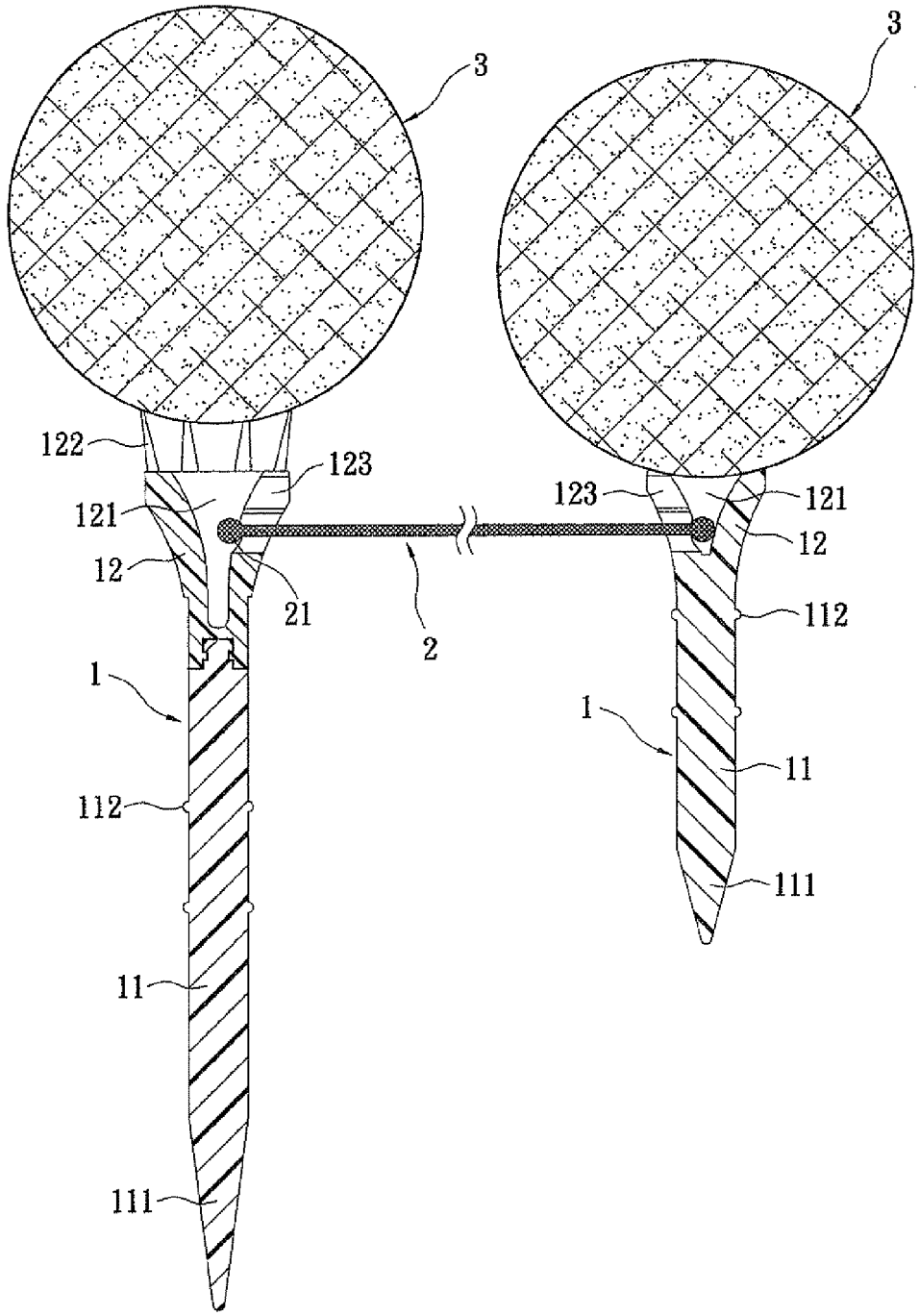
FIG. 3 is a cross-sectional view in accordance with the first embodiment of the present invention.
Figure 5:
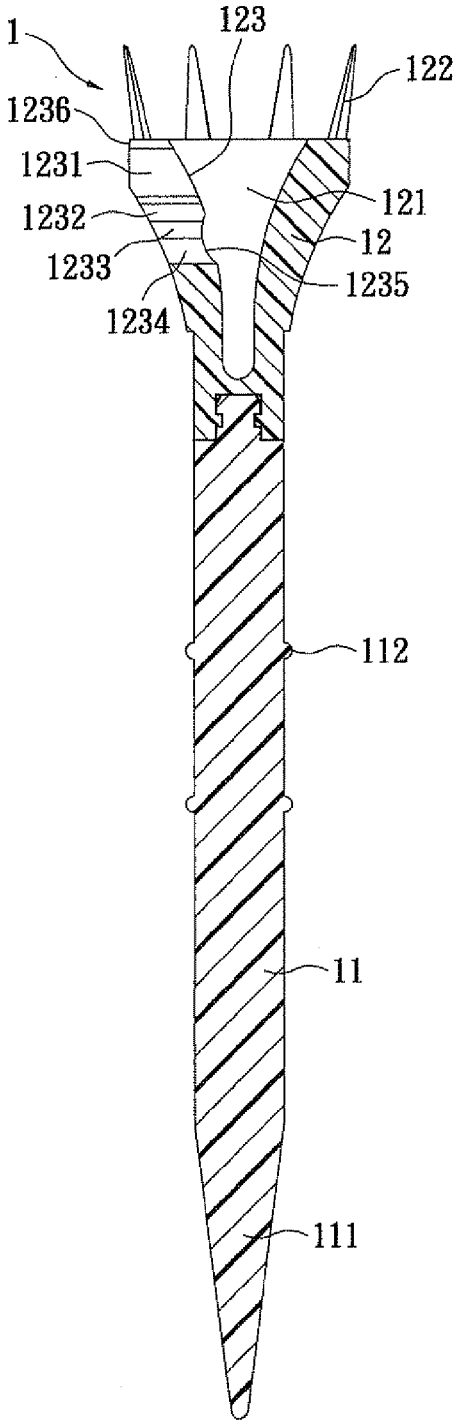
FIG. 5 is a cross-sectional view of the first tee of the first embodiment of the present invention.
Figure 4:
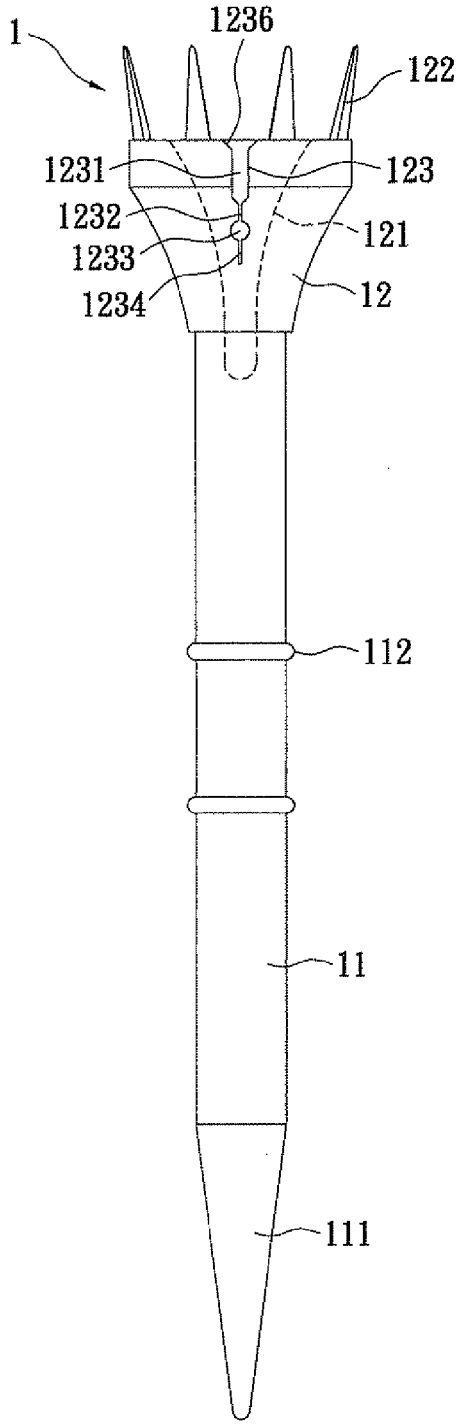
FIG. 4 is a side view of the first tee in accordance with the first embodiment of the present invention.
Figure 7:
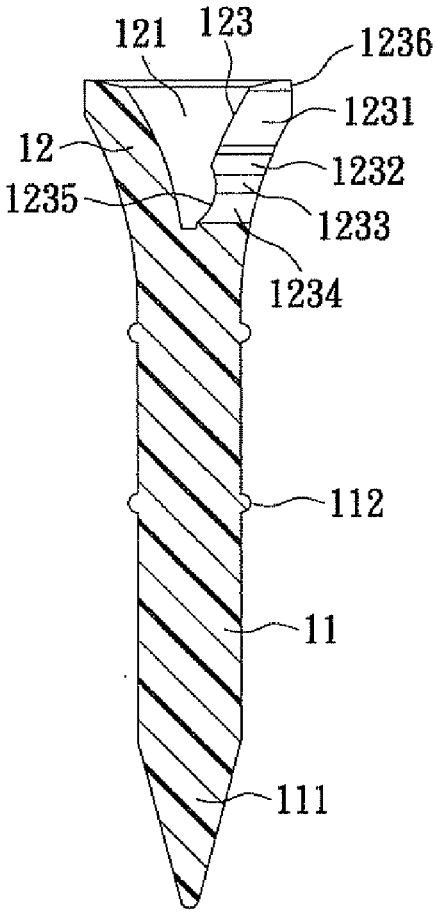
FIG. 7 is a cross-sectional view of the second tee in accordance with the first embodiment of the present invention.
Figure 6:
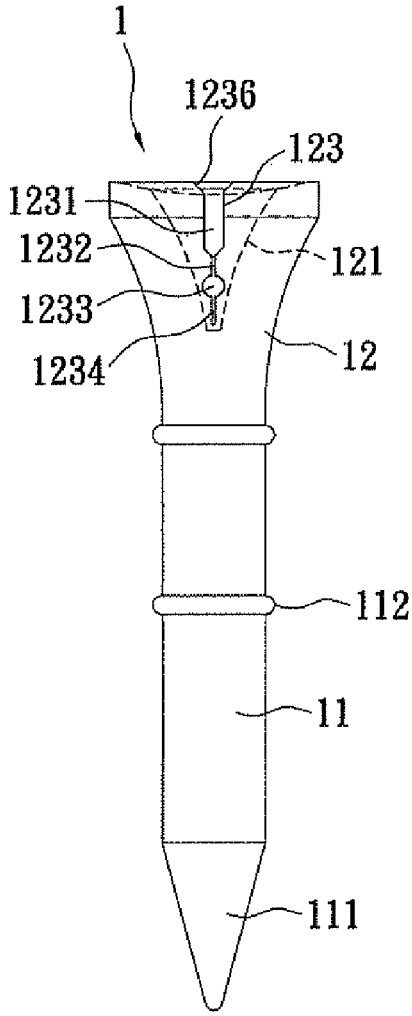
FIG. 6 is a side view of the second tee of the first embodiment of the present invention.

The present invention provides a golf tee with a connecting wire. Please refer to FIGS. 1-7 illustrating a first embodiment of the present invention, the golf tee with a connecting wire includes two tees 1 and a connecting wire 2 (as shown in FIG. 3). The two tees 1 are made of plastic or other materials and they are almost the same in structure design, but the difference of the two tees 1 is that the two tees 1 have different height, wherein the higher tee 1 (the first tee as shown in FIG. 4 and FIG. 5) may be used for hitting a long drive and the lower tee 1 (the second tee as shown in FIG. 6 and FIG. 7) may be used for short-jerking a golf ball. The two tees 1 each have a nail rod 11 and a ball holding portion 12. The nail rod 11 is a columnar rod and has a sharp cone portion 111 formed on the lower end thereof for being driven into the turf. The nail rod 11 has a plurality of spaced indication lines 112 around the periphery thereof for indicating height.

Figure 8:
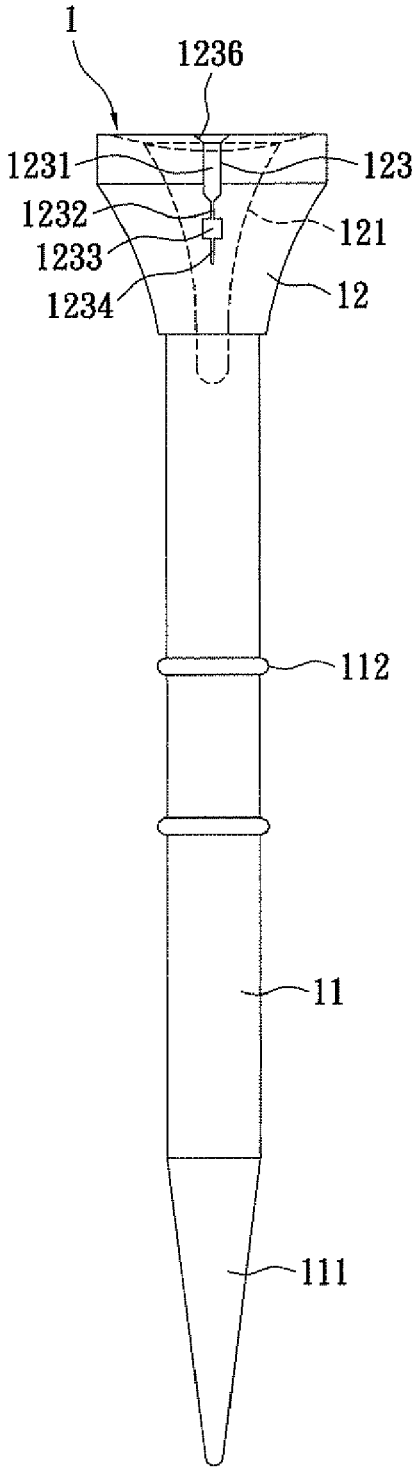
FIG. 8 is a side view of the first tee in accordance with the second embodiment of the present invention.
Figure 11:
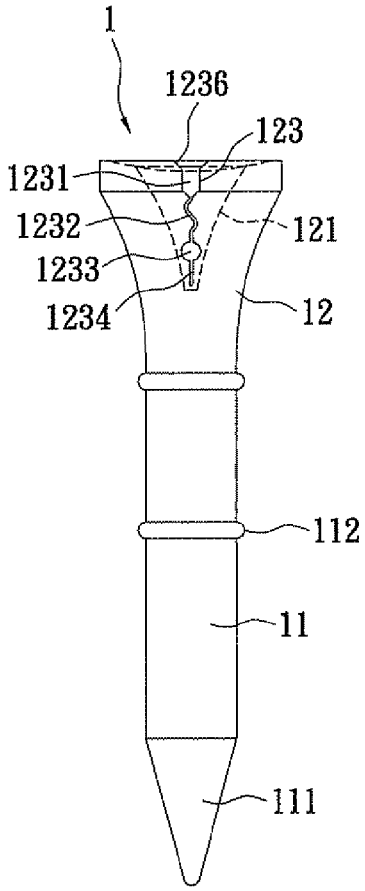
FIG. 11 is a side view of the second tee in accordance with the third embodiment of the present invention.
Figure 10:
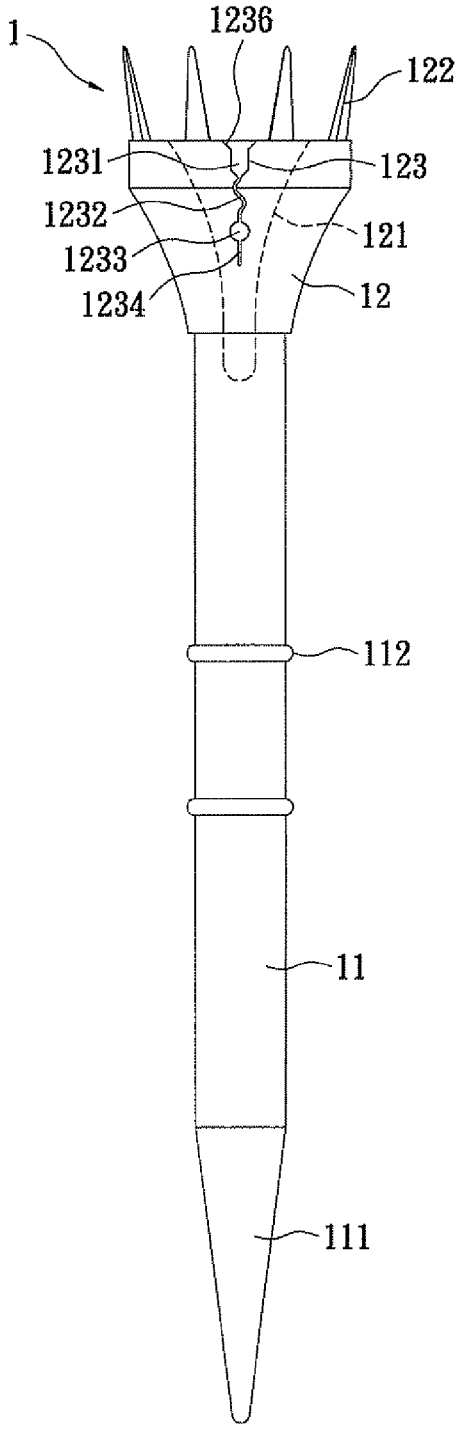
FIG. 10 is a side view of the first tee in accordance with the third embodiment of the present invention.
Figure 13:
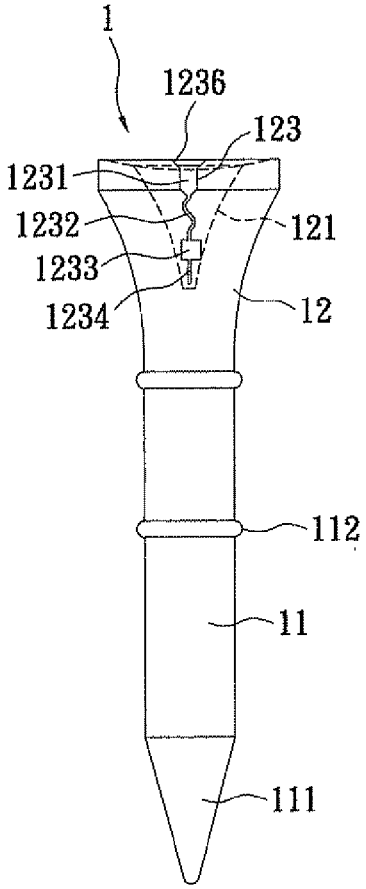
FIG. 13 is a side view of the second tee in accordance with the fourth embodiment of the present invention.
Figure 12:
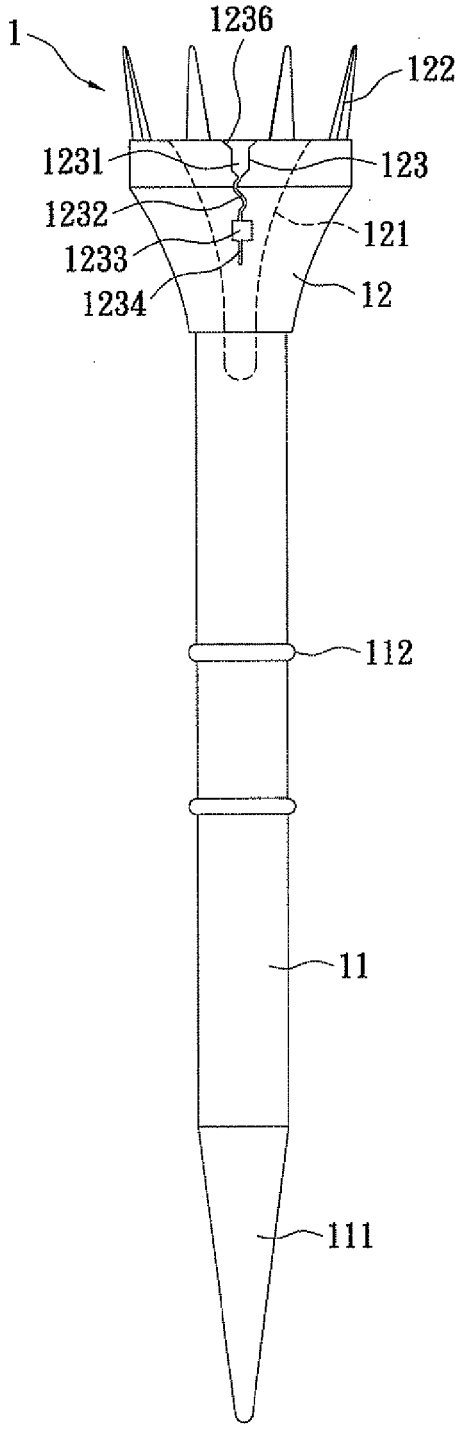
FIG. 12 is a side view of the first tee in accordance with the fourth embodiment of the present invention.
Figure 15:
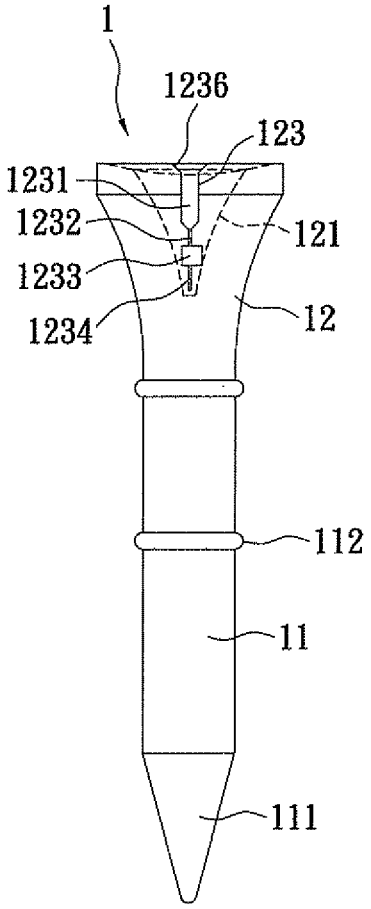
FIG. 15 is a side view of the second tee in accordance with the fifth embodiment of the present invention.
Figure 14:
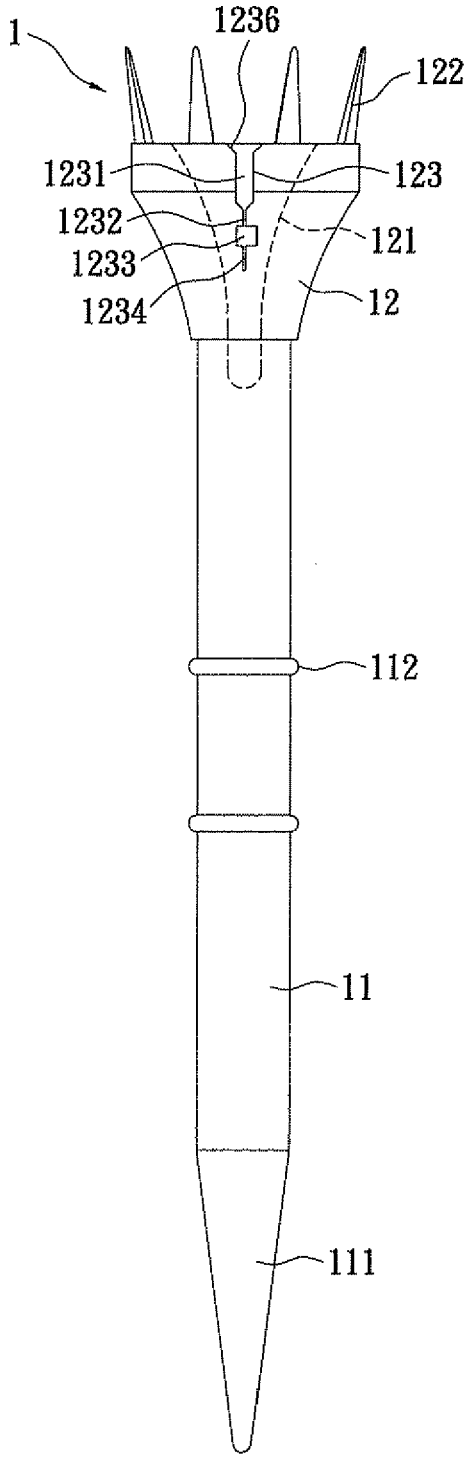
FIG. 14 is a side view of the first tee in accordance with the fifth embodiment of the present invention.

The ball holding portion 12 is connected with the top of the nail rod 11 for supporting a golf ball 3. The ball holding portion 12 is integrally mounted on the top of the nail rod 11, and alternatively, the ball holding portion 12 may also be assembled with the nail rod 11 on the top. The ball holding portion 12 and the nail rod 11 can be made of one kind of material or a plurality of kinds of materials, and in the embodiment, the nail rod 11 is made of hard plastic such as polycarbonate (PC), and the ball holding portion 12 is made of soft plastic such as polyurethane (PU). The outer diameter of the ball holding portion 12 is increasing from bottom to top so that the ball holding portion 12 is in cone-shaped. A groove 121 is formed in the top of the ball holding portion 12 and extends inside the ball holding portion 12 until a proper depth is reached. According to the higher tee 1 (as shown in FIG. 4 and FIG. 5), the ball holding portion 12 further has a plurality of supporting portions 122 protruding from the peripheral edge of the groove 121 on the top of the ball holding portion 12. The supporting portions 122 are in sheet-shaped and disposed on the top of the ball holding portion 12 at intervals to support the golf ball 3. The supporting portions 122 may also be omitted (as shown in FIG. 8).

The ball holding portion 12 has a connecting slot 123 formed in one side thereof, which extends from the outer edge of the ball holding portion 12 to the inner edge of the ball holding portion 12, that is, is connected with the groove 121. The connecting slot 123 includes an opening portion 1231, a passage portion 1232, a fixing portion 1233 and an elastic portion 1234 which are disposed from top to bottom in turn.

The opening portion 1231 extends to the top of the ball holding portion 12 so that the top of the connecting slot 123 is open to allow the connecting wire 2 to pass through the opening portion 1231 into the connecting slot 123 from top to bottom. The opening portion 1231 has bevels 1236 formed on two sides thereof for leading one end of the connecting wire 2 into the connecting slot 123. The passage portion 1232 is located below the opening portion 1231 and is a straight slot which has a width smaller than that of the opening portion 1231. The passage portion 1232 can have proper elastic tightness basing on the elastic portion 1234. The fixing portion 1233 is located below the passage portion 1232 and is a slot in circular (as shown in FIG. 4 and FIG. 6), quadrate or other shapes for receiving one end of the connecting wire 2. The elastic portion 1234 is located below the fixing portion 1233 and is a U-shaped slot for providing the connecting slot 123 with proper elasticity so that the passage portion 1232 can elastically shrink to prevent the connecting wire 2 from moving upwards and escaping out of the connecting slot 123.

The opening portion 1231, the passage portion 1232, the fixing portion 1233 and the elastic portion 1234 aren't limited in shape and can be changed properly, and the elastic portion 1234 may also be omitted.

Figure 16:
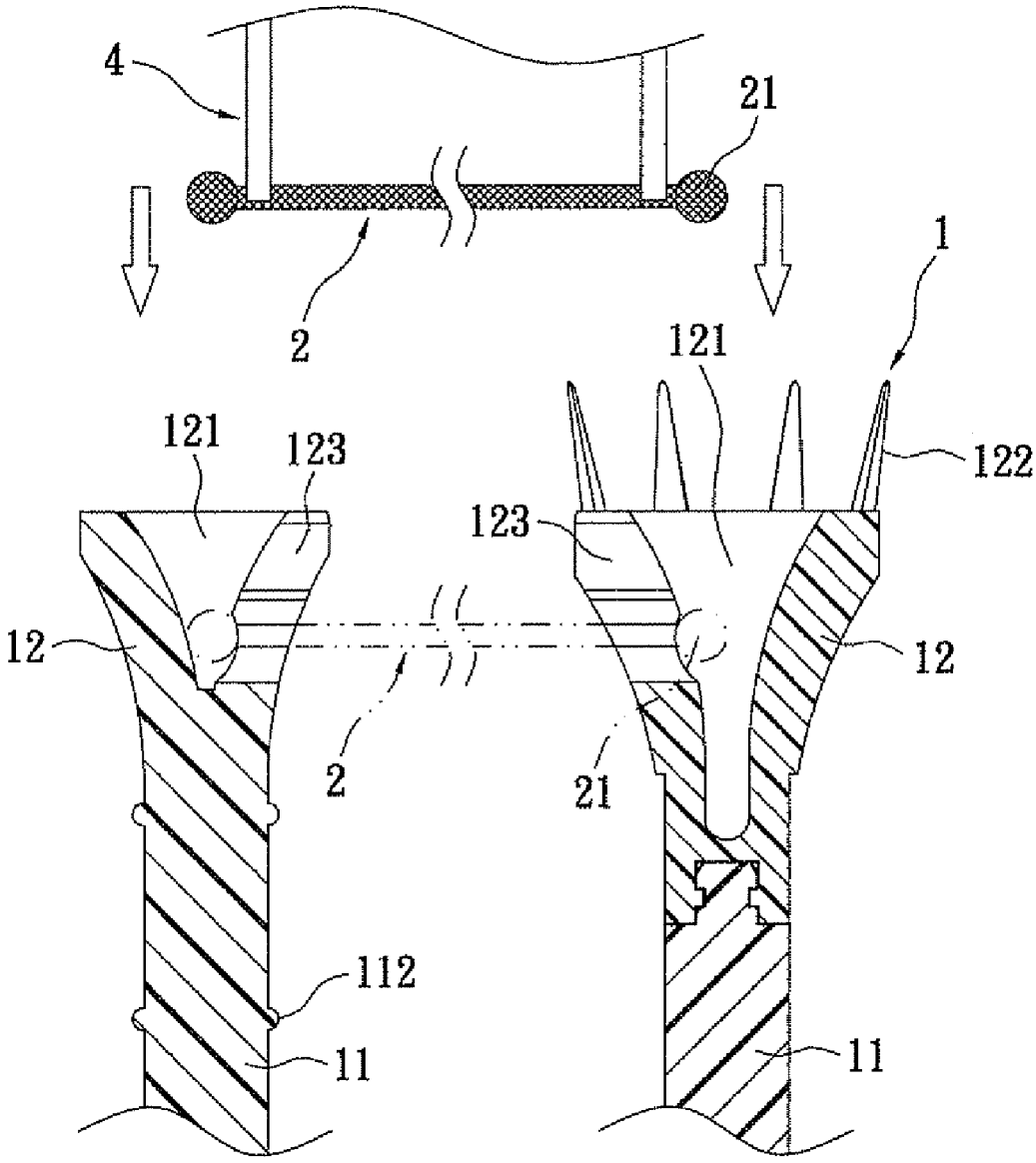
FIG. 16 is a schematic view showing that two ends of a connecting wire in accordance with the present invention are inserted in the connecting slots of the tees.

The connecting wire 2 isn't limited in length and materials. Two ends of the connecting wire 2 are connected with the two tees 1, and one end of the connecting wire 2 passes through the opening portion 1231 into the connecting slot 123 of one tee 1 via a fixture 4 (as shown in FIG. 16) and then passes through the passage portion 1232 into the fixing portion 1233. The operation of inserting the connecting wire 2 into the connecting slot 123 can be performed in an automatic way. The end of the connecting wire 2 forms a larger blocked portion 21 which is located in the groove 121, and the outer diameter of the blocked portion 21 is larger than the inner diameter of the fixing portion 1233 to avoid that the connecting wire 2 is detached from the tee 1 and ensure that the end of the connecting wire 2 can be fixed in the tee 1. The connecting slot 123 has an arc-shaped positioning groove 1235 concavely formed in the inner edge thereof to ensure that the blocked portion 21 is located in the positioning groove 1235 firmly. The other end of the connecting wire 2 is also fixed in the other tee 1 in the same way, and thereby connecting the two tees 1 in between.

Figure 9:
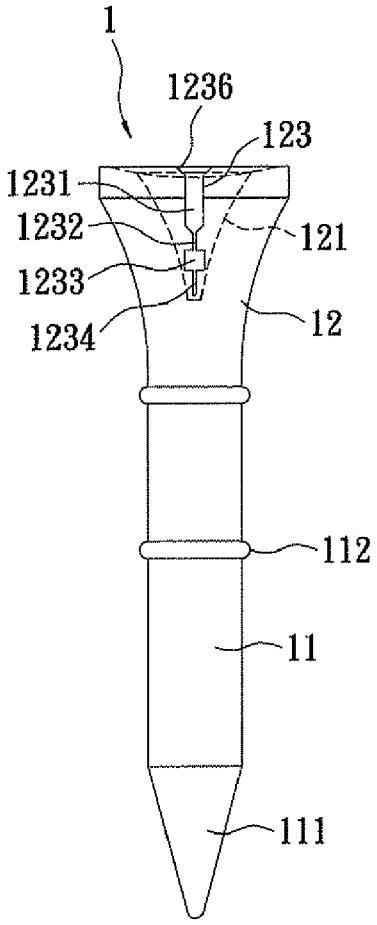
FIG. 9 is a side view of the second tee in accordance with the second embodiment of the present invention.

Please refer to FIG. 8 and FIG. 9, in a second embodiment of the present invention, the fixing portion 1233 of the connecting slot 123 is a quadrate slot.

Please refer to FIG. 10, FIG. 11 and FIG. 12, FIG. 13, in a third embodiment and a fourth embodiment of the present invention, the passage portion 1232 of the connecting slot 123 is an S-shaped slot which has a width smaller than the width of the opening portion 1231. The passage portion 1232 can shrink to prevent the connecting wire 2 from moving upwards and releasing from the connecting slot 123 more effectively.

Please refer to FIG. 12, FIG. 13 and FIG. 14, FIG. 15, in the fourth embodiment and a fifth embodiment of the present invention, the fixing portion 1233 of the connecting slot 123 is bilaterally dissymmetrical in width, so the connecting wire 2 can be fixed more firmly.

Figure 18:
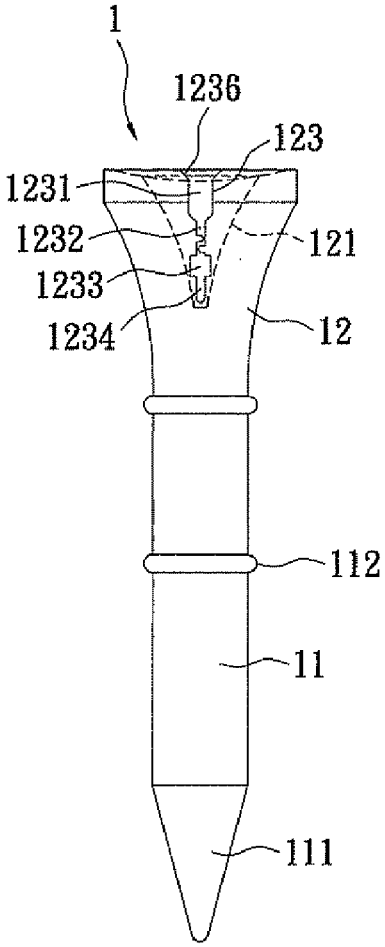
FIG. 18 is a side view of the second tee in accordance with the seventh embodiment of the present invention.
Figure 17:
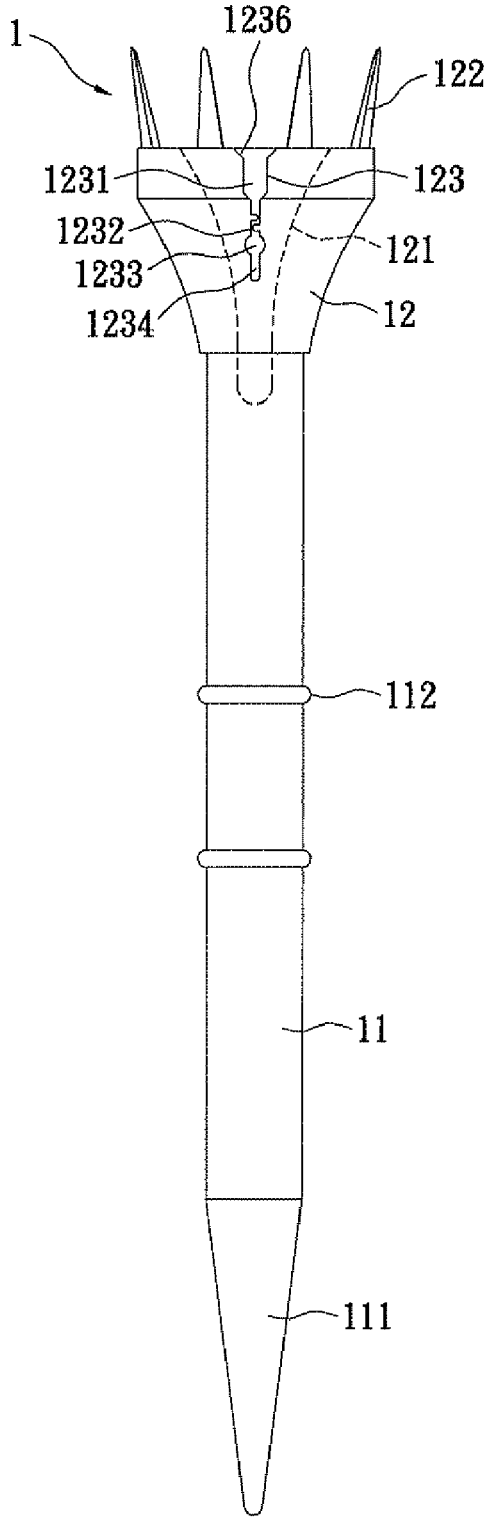
FIG. 17 is a side view of the first tee in accordance with the sixth embodiment of the present invention.

Please refer to FIG. 17 and FIG. 18, in a sixth embodiment and a seventh embodiment of the present invention, the passage portion 1232 of the connecting slot 123 is an S-shaped slot which is formed by concave-convex portions formed on two sides of the inner wall of the passage portion 1232.

Furthermore, the connecting wire 2 associated with the present invention may also only have one end connecting with one tee 1, and the other end of the connecting wire 2 may be connected with other devices such as a ball peg (not shown).

Figure 19:
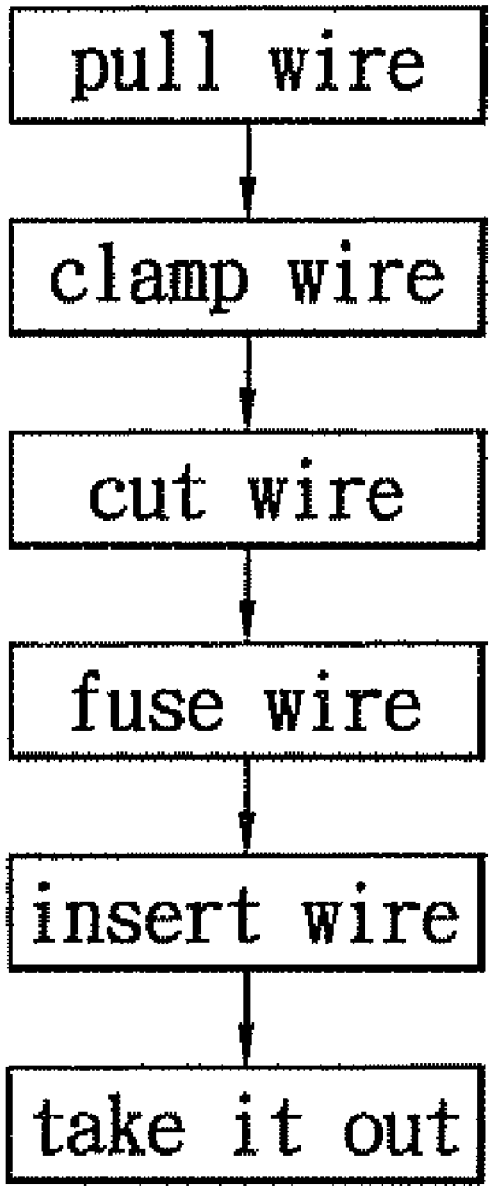
FIG. 19 is a flow chart of a manufacturing method in accordance with the present invention.

Please refer to FIG. 19 simultaneously, a method of manufacturing the golf tee with a connecting wire of the present invention includes the steps as follows:

(1). First, forming two tees 1 which each have a nail rod 11 and a ball holding portion 12, wherein the ball holding portion 12 has a connecting slot 123 formed in one side thereof, and the connecting slot 123 includes an opening portion 1231, a passage portion 1232, a fixing portion 1233 and an elastic portion 1234;

(2). Pulling a connecting wire 2 out to perform a wire pulling operation via a wire wheel, clamping the connecting wire 2 to perform a wire clamping operation via a fixture 4, cutting the connecting wire 2 to a proper length to perform a wire cutting operation, and fusing two ends of the connecting wire 2 to perform a wire fusing operation via heating so that the two ends of the connecting wire 2 form larger blocked portions (wire heads) 21 of which outer diameters are larger than the inner diameter of the fixing portions 1233. Then inserting the two ends of the connecting wire 2 into the connecting slots 123 of the two tees 1 through the opening portions 1231 from top to bottom to perform a wire inserting operation via the fixture 4, so that the two ends of the connecting wire 2 pass through the passage portions 1232 of the connecting slots 123 associated with the two tees 1 into the fixing portions, the blocked portions 21 are located in the grooves 121, and the two ends of the connecting wire 2 are connected with and fixed in the two tees 1. Finally, taking out the finished product.

The ball holding portion 12 of each tee 1 in accordance with the present invention includes the connecting slot 123, and the connecting slot 123 has the opening portion 1231, so that the top of the connecting slot 123 is open, to enable the connecting wire 2 to be inserted into the fixing portion 1233 through the opening portion 1231 of the connecting slot 123, thereby achieving the connection between the connecting wire 2 and the tees 1 rapidly. The golf tee with a connecting wire of the present invention can be assembled easily, firmly and conveniently for automatic production, and the manufacturing method can save time and energy, improve production efficiency and reduce costs.

The connecting slot 123 of the present invention has the passage portion 1232 which can elastically shrink by utilizing the elastic portion 1234 properly. Due to the plastic elastic principle that plastic shrinks naturally after being thermoformed and cooled, cooperating with the concave-convex portions of the passage portion 1232, the present invention can prevent the connecting wire 2 from moving upwards and releasing from the connecting slot 123.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. A golf tee with a connecting wire, comprising a tee, having a nail rod and a ball holding portion connected with a top of the nail rod, the ball holding portion having a groove formed in a top thereof and a connecting slot formed in one side thereof, and the connecting slot connected with the groove, wherein the connecting slot includes an opening portion, a passage portion and a fixing portion, each extending along an outer surface of the tee and the opening portion extends to the top of the ball holding portion, the passage portion is located below the opening portion, a width of the passage portion is smaller than that of the opening portion, and the fixing portion is located below the passage portion; and a connecting wire, of which one end passes through the opening portion and the passage portion of the connecting slot into the fixing portion and forms a blocked portion which is located in the groove so that the end of the connecting wire is connected with the tee.

2. The golf tee with a connecting wire as claimed in claim 1, wherein an elastic portion is formed below the fixing portion so that the passage portion elastically shrinks.

3. The golf tee with a connecting wire as claimed in claim 2, wherein the elastic portion is a U-shaped slot.

4. The golf tee with a connecting wire as claimed in claim 1, wherein the fixing portion is a circular or quadrate slot.

5. The golf tee with a connecting wire as claimed in claim 1, wherein the ball holding portion includes a plurality of supporting portions protruding from a peripheral edge of the groove on the top of the ball holding portion.

6. The golf tee with a connecting wire as claimed in claim 1, wherein an outer diameter of the blocked portion of the connecting wire is larger than an inner diameter of the fixing portion of the connecting slot.

7. The golf tee with a connecting wire as claimed in claim 1, wherein the connecting slot includes a positioning groove concavely formed in an inner edge thereof and the blocked portion of the connecting wire is located in the positioning groove.

8. The golf tee with a connecting wire as claimed in claim 1, wherein the fixing portion of the connecting slot is bilaterally dissymmetrical.

9. The golf tee with a connecting wire as claimed in claim 1, wherein the passage portion of the connecting slot is a straight or S-shaped slot.

10. The golf tee with a connecting wire as claimed in claim 1, comprising another tee connected with the other end of the connecting wire.

* * * * *